US006698196B2

(12) United States Patent
Hashimoto et al.

(10) Patent No.: US 6,698,196 B2
(45) Date of Patent: Mar. 2, 2004

(54) DRIVE CIRCUIT FOR FLUID MOTOR

(75) Inventors: Masataka Hashimoto, Gifu (JP); Osamu Nohara, Gifu (JP)

(73) Assignee: Teijin Seiki Co., Ltd., Tokyo (JP)

( * ) Notice: Subject to any disclaimer, the term of this patent is extended or adjusted under 35 U.S.C. 154(b) by 159 days.

(21) Appl. No.: 10/099,051

(22) Filed: Mar. 14, 2002

(65) Prior Publication Data

US 2002/0157390 A1 Oct. 31, 2002

(30) Foreign Application Priority Data

Mar. 15, 2001 (JP) ..... P2001-073446
Jan. 11, 2002 (JP) ..... P2002-005319

(51) Int. Cl.[7] ..... F16D 31/02
(52) U.S. Cl. ..... 60/443; 92/12.2; 91/506
(58) Field of Search ..... 60/443; 92/12.2; 91/506

(56) References Cited

U.S. PATENT DOCUMENTS 4,481,769 A * 11/1984 Nagahara ..... 60/441
4,495,767 A * 1/1985 Akiyama et al. ..... 60/436
5,531,071 A * 7/1996 Asano ..... 60/441
5,992,148 A * 11/1999 Satake ..... 60/468

* cited by examiner

*Primary Examiner*—Edward K. Look
*Assistant Examiner*—Igor Kershteyn
(74) *Attorney, Agent, or Firm*—Akin Gump Strauss Hauer & Feld LLP

(57) ABSTRACT

When the load acting on a fluid motor (25) increases, a changeover valve (61) starts to be changed over toward a low-speed position L, but at this time an additional pilot fluid whose pressure is determined by the amount of fluid flowing into or out of a second passage (68) through first and second notches functions as a pressure regulator for a spool (65), and lowers the pressure within the second passage (68) without lowering the pressure within a high pressure-side main circuit (28), thereby tilting a swash plate (26) from a position of high-speed rotation to a position of low-speed rotation.

5 Claims, 10 Drawing Sheets

DRIVE CIRCUIT FOR FLUID MOTOR

BACKGROUND OF THE INVENTION

The present invention relates to a drive circuit for a fluid motor having a swash plate which is tiltable between positions of high-speed and low-speed rotation.

A related drive circuit for a fluid motor is shown in FIG. 10. This drive circuit is comprised of a fluid motor 12 having a swash plate 11 which is tiltable between positions of high-speed and low-speed rotation; a reduction gear 10 coupled to the fluid motor 12 and adapted to reduce the output rotational speed of the fluid motor 12 before outputting it; a tilting piston 13 which, when a high-pressure fluid is introduced to it, pushes and tilts the swash plate 11 to the position of high-speed rotation, and which, when set under a tank pressure, allows the swash plate 11 to tilt to the position of low-speed rotation; a changeover valve 18 which is interposed midway in a connecting passage 17 for connecting the tilting piston 13 and a selector valve 16 for selectively obtaining the high-pressure fluid from main circuits 14 and 15 of the fluid motor 12, and which is changed over between a high-speed position K for introducing to the tilting piston 13 the high-pressure fluid obtained by the selector valve 16 and a low-speed position L for discharging the fluid acting on the tilting piston 13 to a drain passage 22; a first pilot passage 19 for introducing into the changeover valve 18 a constant-pressure pilot fluid for a direction in which the changeover valve 18 is changed over to the high-speed position K; and a second pilot passage 21 for introducing into the changeover valve 18 the high-pressure fluid selectively obtained from the main circuits 14 and 15 by a counterbalance valve 20, for a direction in which the changeover valve 18 is changed over to the low-speed position L.

In the above-described drive circuit for the fluid motor 12, during a normal load, the fluid force based on the constant-pressure pilot fluid in the first pilot passage 19 is higher than the fluid force based on the high-pressure fluid (the high-pressure fluid selectively obtained from the high pressure-side main circuits 14 and 15) in the second pilot passage 21, so that the changeover valve 18 has been changed over to the high-speed position K. Consequently, the high-pressure fluid from the main circuits 14 and 15 obtained by the selector valve 16 causes the tilting piston 13 to project through the connecting passage 17, thereby holding the swash plate 11 at the position of high-speed rotation.

Next, when the load acting on the above-described fluid motor 12 increases, the pressure in the main circuits 14 and 15 on the high-pressure side increases, so that the fluid force based on the high-pressure fluid in the second pilot passage 21 becomes higher than the fluid force based on the constant-pressure pilot fluid in the first pilot passage 19. Consequently, the changeover valve 18 is changed over to the low-speed position L, so that the fluid acting on the tilting piston 13 is discharged to the drain passage 22, and the swash plate 11 is tilted to the position of low-speed rotation while pushing the tilting piston 13. As a result, the fluid motor 12 rotates at low speed with a large torque, and the pressure within the high pressure-side main circuits 14 and 15 declines.

However, with such a drive circuit for a fluid motor, since the fluid acting on the tilting piston 13 is instantly discharged into the drain passage 22 simultaneously as the changeover valve 18 is changed over to the low-speed position L, the swash plate 11 is suddenly tilted to the position of low-speed rotation, and the pressure within the high pressure-side main circuits 14 and 15 declines. Consequently, the output torque of the fluid motor 12 instantly changes from a small torque with high-speed rotation to a large torque with low-speed rotation, with the result that there are problems in that a shock can be imparted to an operator to deteriorate an operational feeling, and a large load can be imparted to the drive circuit itself and shorten its life.

In addition, if the swash plate 11 is suddenly tilted to the position of low-speed rotation and the pressure within the high pressure-side main circuits 14 and 15 declines substantially as described above, the fluid force based on the constant-pressure pilot fluid in the first pilot passage 19 becomes higher than the fluid force based on the high-pressure fluid in the second pilot passage 21, and the changeover valve 18 is changed over again to the high-speed position K. However, when the changeover valve 18 is thus changed over to the high-speed position K, the pressure within the high pressure-side main circuits 14 and 15 rises again, so that the changeover valve 18 is changed over again to the low-speed position L. Hence, there is a problem in that the changeover valve 18 is repeatedly changed over between the high-speed position K and the low-speed position within a short time, i.e., hunting due to pressure fluctuations of the fluid motor 12 can occur.

SUMMARY OF THE INVENTION

The object of the invention is to provide a drive circuit for a fluid motor which is capable of improving the operational feeling and prolong the life of the drive circuit while preventing hunting at the time of changeover of the changeover valve to the low-speed position.

The above object can be attained by a drive circuit for a fluid motor including a fluid motor having a swash plate which is tiltable between positions of high-speed and low-speed rotation; a tilting piston which, when a high-pressure fluid is introduced thereto, pushes and tilts the swash plate and tilts it to the position of high-speed rotation, and which, when set under a tank pressure, allows the swash plate to tilt to the position of low-speed rotation; a changeover valve which is interposed midway in a connecting passage for connecting the tilting piston and a selector valve for selectively obtaining the high-pressure fluid from two main circuits of the fluid motor, and which is changed over between a high-speed position for introducing to the tilting piston the high-pressure fluid obtained by the selector valve and a low-speed position for discharging the fluid acting on the tilting piston to a drain passage; a first pilot passage for introducing into the changeover valve a constant-pressure pilot fluid for a direction in which the changeover valve is changed over to the high-speed position; and a second pilot passage for introducing into the changeover valve the high-pressure fluid selectively obtained from the main circuits, for a direction in which the changeover valve is changed over to the low-speed position, the drive circuit for a fluid motor characterized in that:

an additional pilot passage is provided for introducing from the connecting passage between the changeover valve and the tilting piston into the changeover valve an additional pilot fluid for the direction in which the changeover valve is changed over to the low-speed position, and that a first narrow passage for allowing the drain passage and the connecting passage extending from the changeover valve on a tilting piston side to communicate with each other and a second narrow passage for allowing the connecting passage extending from the changeover valve on the tilting piston side and the communicating passage extending from the changeover valve on the selector valve side to communicate with each other are provided midway in a stroke in which the changeover valve is changed over from the high-speed position to the low-speed position.

When the two main circuits are under low pressure and the rotation of the fluid motor is stopped, the constant-pressure pilot fluid is only being introduced into the changeover valve through the first pilot passage, so that the changeover valve remains changed over to the high-speed position.

Next, when the high-pressure fluid is supplied to either one of the main circuits, the fluid motor rotates. At this time, the high-pressure fluid in the high pressure-side main circuit obtained by the selector valve is introduced to the tilting piston through the connecting passage to tilt the swash plate to the position of high-speed rotation. In addition, the high-pressure fluid flowing through this connecting passage is introduced into the changeover valve as an additional pilot fluid through the additional pilot passage.

Consequently, the fluid force based on the constant-pressure pilot fluid in the first pilot passage is applied to the changeover valve as the changing-over force for directing the changeover valve toward the high-speed position. Meanwhile, applied as the changing-over force for directing the changeover valve toward the low-speed position is the resultant force of the fluid force based on the high-pressure fluid obtained from the high pressure-side main circuit and introduced through the second pilot passage and the fluid force based on the additional pilot fluid (under the same pressure as the pressure within the second pilot passage) in the additional pilot passage obtained by the selector valve.

Here, when a normal load is being applied to the fluid motor, the aforementioned changing-over force for directing the changeover valve toward the high-speed position is larger than the aforementioned changing-over force for directing the changeover valve toward the low-speed position, the changeover valve is held at the high-speed position.

Next, when the load acting on the fluid motor increases, the pressure within the high pressure-side main circuit rises, and the resultant force of the fluid force based on the high-pressure fluid in the second pilot passage and the fluid force based on the additional pilot fluid in the additional pilot passage becomes larger than the fluid force based on the constant-pressure pilot fluid in the first pilot passage, so that the changeover valve starts to be changed over from the high-speed position to the low-speed position.

Midway in this process of changeover to the low-speed position, the connecting passage extending from the changeover valve on the tilting piston side communicates with the drain passage through the first narrow passage, so that a small amount of the fluid in the connecting passage at in that region is discharged to the drain passage, and the pressure drops. As a result, the pressing force applied to the swash plate by the tilting piston becomes small, and the swash plate starts to tilt from the position of high-speed rotation toward the position of low-speed rotation.

Here, when the pressure within the connecting passage extending from the changeover valve on the tilting piston side, i.e., the pressure of the additional pilot fluid, drops as described above, the fluid force being applied to the changeover valve by the additional pilot fluid also becomes small, so that the changing-over force (resultant force) for directing the changeover valve toward the low-speed position L becomes small. Further, when this resultant force becomes lower than the fluid force based on the constant-pressure pilot fluid, the changeover valve is pushed back toward the high-speed position, whereas when the resultant force becomes higher than the fluid force based on the constant-pressure pilot fluid, the changeover valve is pushed back toward the low-speed position.

The changeover valve thus moves to the position where a balance is established between the resultant force for directing the changeover valve toward the low-speed position and the fluid force based on the constant-pressure pilot fluid for directing the changeover valve toward the high-speed position. Of this resultant force, the fluid force based on the additional pilot fluid is determined by the amount of fluid flowing out from the connecting passage extending from the changeover valve on the tilting piston side into the drain passage through the first narrow passage and the amount of fluid flowing from connecting passage extending from the changeover valve on the selector valve side into the connecting passage extending from the changeover valve on the tilting piston side through the second narrow passage. The fluid force which is thus imparted to the changeover valve by the additional pilot fluid functions as a pressure regulator for the changeover valve. At this time, the swash plate also tilts to an intermediate position between the position of high-speed rotation and the position of low-speed rotation in correspondence with the pressure within the connecting passage extending from the changeover valve on the tilting piston side.

Then, when the pressure within the high pressure-side main circuit gradually increases in correspondence with the increase in the load acting on the fluid motor, of the resultant force which is balanced with the fluid force of a fixed value based on the constant-pressure pilot fluid, the fluid force based on the high-pressure fluid in the second pilot passage becomes gradually large. Hence, the remaining fluid force, i.e., the fluid force imparted to the changeover valve by the additional pilot fluid, becomes gradually small; namely, the pressure within the connecting passage extending from the changeover valve on the tilting piston side gradually drops, thereby causing the swash plate to tilt gradually toward the position of low-speed rotation. When the pressure within the connecting passage extending from the changeover valve on the tilting piston side is thus caused to drop to the level of the pressure within the drain passage (tank pressure), the changeover valve is changed over to the low-speed position, and the swash plate tilts to the position of low-speed rotation.

While the swash plate tilts from the position of high-speed rotation to the position of low-speed rotation owing to the changeover of the changeover valve to the low-speed position, the pressure within the high pressure-side main circuit of the fluid motor does not undergo a sharp drop and only rises gradually in correspondence with the load under constant-pressure control. Therefore, no shock occurs in the drive circuit, the operational feeling improves, a long life is obtained, and the occurrence of hunting is prevented.

In addition, if the arrangement according to claim 2 is provided, it is possible to control the above-described operation with high accuracy.

Furthermore, if the arrangements according to claims 3 and 5 are provided, the first and second narrow passages can be provided in the spool or the spool chamber of the changeover valve simply and at low cost.

In addition, if the arrangement according to claim 5 is provided, a counterbalance valve, for example, for obtaining from the main circuits the high-pressure fluid (pilot fluid) to be introduced into the changeover valve becomes unnecessary, so that the structure becomes simple, and the fabrication cost can be lowered.

Two or more of the arrangements of claims 2 to 5 can be combined with the arrangement of claim 1 to provided the combined effects.

The present disclosure relates to the subject matter contained in Japanese patent application Nos. 2001-73446 (filed on Mar. 15, 2001) and 2002-5319 (filed on Jan. 11, 2002), which are expressly incorporated herein by reference in their entireties.

DESCRIPTION OF THE PREFERRED EMBODIMENT

Figure 1:
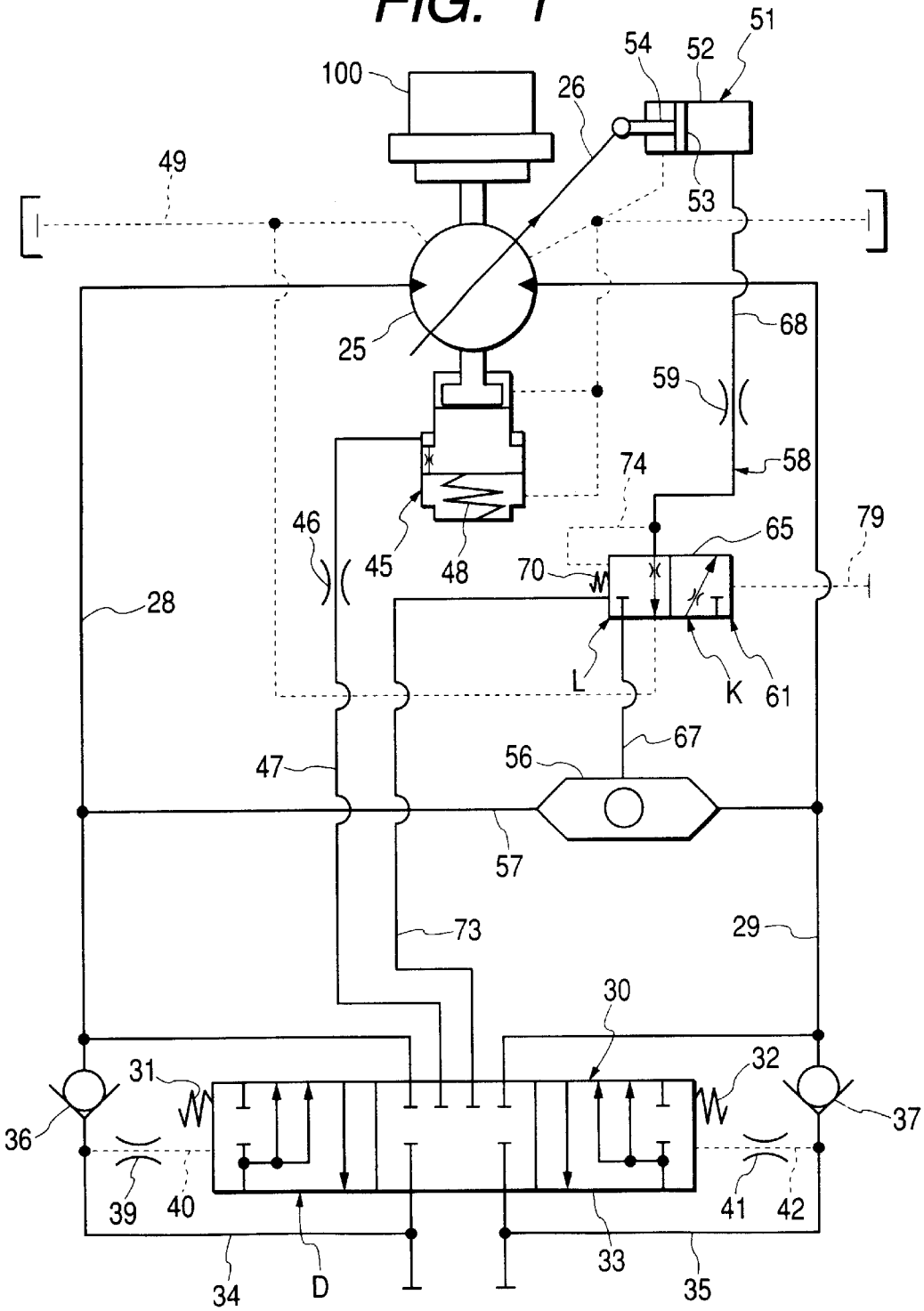
FIG. 1 is a circuit diagram illustrating a first embodiment of the invention.

Referring now to the drawings, a description will be given of a first embodiment of the invention.

In FIG. 1, reference numeral 25 denotes a fluid motor for imparting a driving force for traveling to a civil engineering and construction machine such as a power shovel. This fluid motor 25 is a two-speed motor and has a swash plate 26 which is capable of tilting between two tilting positions of the position of high-speed rotation and the position of low-speed rotation. When this swash plate 26 is set to the position of high-speed rotation, the suction capacity of the fluid motor 25 is changed over to a small level, and the fluid motor 25 undergoes high-speed rotation. Meanwhile, when the swash plate 26 is set to the position of low-speed rotation, the suction capacity of the fluid motor 25 is changed over to a high level, and the fluid motor 25 undergoes low-speed rotation. A reduction gear 100 is coupled to the fluid motor 25, and this reduction gear 100 reduces the output rotational speed of the fluid motor 25 before outputting it.

The fluid motor 25 and an unillustrated manual changeover valve are connected by a pair of main circuits 28 and 29, and a counterbalance valve 30 which is capable of selectively obtaining a high-pressure fluid from the high-pressure side of the main circuits 28 and 29 is interposed midway in the main circuits 28 and 29. This counterbalance valve 30 has a valve body 33 which is urged so as to return to a neutral position by springs 31 and 32, and has check valves 36 and 37 which are respectively provided in passages 34 and 35 bypassing the valve body 33.

The passage 34 and the valve body 33 are connected by a pilot passage 40 having a throttle 39 provided midway therein, while the passage 35 and the valve body 33 are connected by a pilot passage 42 having a throttle 41 provided midway therein. These pilot passages 40 and 42 introduce the fluid in the passage 34 (main circuit 28) or the passage 35 (main circuit 29) into the valve body 33 of the counterbalance valve 30 so as to impart a pressing force for counteracting the springs 32 and 31 to the valve body 33.

Reference numeral 45 denotes a negative brake for imparting a braking force when the rotation of the fluid motor 25 is stopped. This negative brake 45 and a high-pressure obtaining port of the counterbalance valve 30 are connected by a fluid path 47 having a throttle 46 provided midway therein. When the high-pressure fluid selectively obtained from the high-pressure side of the main circuits 28 and 29 by the counterbalance valve 30 is supplied to the negative brake 45 through the fluid path 47, the negative brake 45 releases the braking force with respect to the fluid motor 25. Meanwhile, when the high-pressure fluid is not being obtained by the counterbalance valve 30, the fluid is discharged from the negative brake 45 to a drain passage 49 by the urging force of a spring 48, and a braking force is applied to the fluid motor 25.

Reference numeral 51 denotes a tilting cylinder which is capable of imparting a tilting force to the swash plate 26, and a tilting piston 53 is slidably accommodated in a cylinder casing 52 of this tilting cylinder 51. This tilting piston 53 has a piston rod 54 whose distal end abuts against the swash plate 26. consequently, when the high-pressure fluid is introduced to the tilting piston 53 of the tilting cylinder 51, the tilting piston 53 and the piston rod 54 project to press the swash plate 26, so that the swash plate 26 is tilted from the position of low-speed rotation to the position of high-speed rotation. Meanwhile, when the interior of the cylinder casing 52 is set under the tank pressure, and the high-pressure fluid ceases to be introduced to the tilting piston 53, the swash plate 26 is tiled from the position of high-speed rotation to the position of low-speed rotation by the high-pressure fluid which flows into the fluid motor 25 from the high-pressure side of the main circuits 28 and 29. At this time, the tilting piston 53 and the piston rod 54 of the tilting cylinder 51 retract while allowing the tilting.

Reference numeral 56 denotes a selector valve which is interposed midway in a connecting passage 57 for connecting the main circuit 28 and the main circuit 29, and this selector valve 56 selectively obtaines the high-pressure fluid from the high pressure-side main circuit 28 or main circuit 29. Reference numeral 58 denotes a connecting passage which connects the selector valve 56 and the tilting piston 53 of the tilting cylinder 51 and has a throttle 59 interposed midway therein. This connecting passage 58 introduces to the tilting piston 53 the high-pressure fluid obtained by the selector valve 56.

In FIGS. 1, 2, 3, and 4, a changeover valve 61 is interposed midway in the connecting passage 58, specifically between the throttle 59 and the selector valve 56. This changeover valve 61 is fixed to the fluid motor 25, and has a casing 62 which is jointly used for the counterbalance valve 30. Reference numeral 63 denotes a spool chamber which is penetratingly formed in the casing 62. One end of this spool chamber 63 is sealed by a plug 64 making up a portion of the casing 62, while the other end thereof is connected to the drain passage 49.

A substantially cylindrical spool 65 is accommodated inside the spool chamber 63 in such a manner as to be axially movable. This spool 65 has a large-diameter portion 65*a* provided in one axial side portion, a small-diameter portion 65*b* provided in the other axial side portion, and an intermediate-diameter portion 65*c* provided between the large-diameter portion 65*a* and the small-diameter portion 65*b*. An annular groove 65*e* having a pressure receiving surface 65*d* is provided between the large-diameter portion 65*a* and the intermediate-diameter portion as 65*c*. Here, the diameters of the large-diameter portion 65*a*, the intermediate-diameter portion 65*c*, and the small-diameter portion 65*b* are smaller in order.

Reference numeral 67 denotes a first passage formed in the casing 62, and one end of the first passage 67 is connected to the selector valve 56, while the other end thereof is open in the spool chamber 63. In addition, reference numeral 68 denotes a second passage which is similarly formed in the casing 62, and one end of the second passage 68 is open in the spool chamber 63, while the aforementioned throttle 59 is provided the other end thereof.

Reference numeral 70 denotes a spring interposed between a flange 71 provided at one end of the spool 65 and a stepped portion 72 formed in the spool chamber 63. This spring 70 urges the spool 65 of the changeover valve 61 toward one axial side, i.e., toward a low-speed position L, with a relatively small force. Reference numeral 73 denotes a second pilot passage formed in the casing 62, and one end of this second pilot passage 73 is connected to a high-pressure obtaining port of the counterbalance valve 30 incorporated in the casing 62, while the other end thereof is open in the spool chamber 63 opposing the aforementioned pressure receiving surface 65*d*. Consequently, when the high-pressure fluid (pilot fluid) selectively obtained from the high-pressure side of the main circuits 28 and 29 by the counterbalance valve 30 is introduced to the pressure receiving surface 65*d* of the spool 65 through the second pilot passage 73, a fluid force directed toward one axial side, i.e., a fluid force acting in the direction for effecting a changeover to the low-speed position L, is imparted to the spool 65 of the changeover valve 61.

Reference numeral 74 denotes an annular groove serving as an additional pilot passage formed on an outer peripheral surface of the spool 65 between the small-diameter portion 65*b* and the intermediate-diameter portion 65*c*, and the fluid (additional pilot fluid) in the connecting passage 58 (second passage 68) between the changeover valve 61 and the tilting piston 53 is introduced through this annular groove 74 to one side surface, i.e., a pressure receiving surface 74*a*, of the annular groove 74. Here, although the pressure receiving area of the pressure receiving surface 74*a* is set to 50% of the pressure receiving area of the aforementioned pressure receiving surface 65*d*, the pressure receiving area of the pressure receiving surface 74*a* is preferably set in the range of 40 to 60%. The reason for this is that if it is less than 40%, the feedback acting force with respect to the pressure receiving surface 74*a* becomes small, and the pressure range of the fluid when the fluid motor 25 undergoes a change from the high-speed rotation to the low-speed rotation becomes small, so that the fluid motor 25 comes to respond too sensitively to pressure fluctuations of the load, whereas, if that pressure receiving area exceeds 60%, the fluid motor 25 undergoes a change from the high-speed rotation to the low-speed rotation under a low pressure, so that the holding capability in high-speed rotation declines.

When the additional pilot fluid is thus introduced to the pressure receiving surface 74*a* of the changeover valve 61 through the annular groove 74, the fluid force directed to one axial side, i.e., the fluid force acting in the direction for effecting a changeover to the low-speed position L, is imparted to the spool 65 of the changeover valve 61. Thus, the force acting in the direction for effecting a changeover to the low-speed position L, i.e., the resultant force of the urging force of the spring 70, the fluid force based on the high-pressure fluid in the second pilot passage 73, and the fluid force based on the additional pilot fluid in the annular groove 74 (additional pilot passage), is imparted to the spool 65 of the changeover valve 61.

Figure 2:
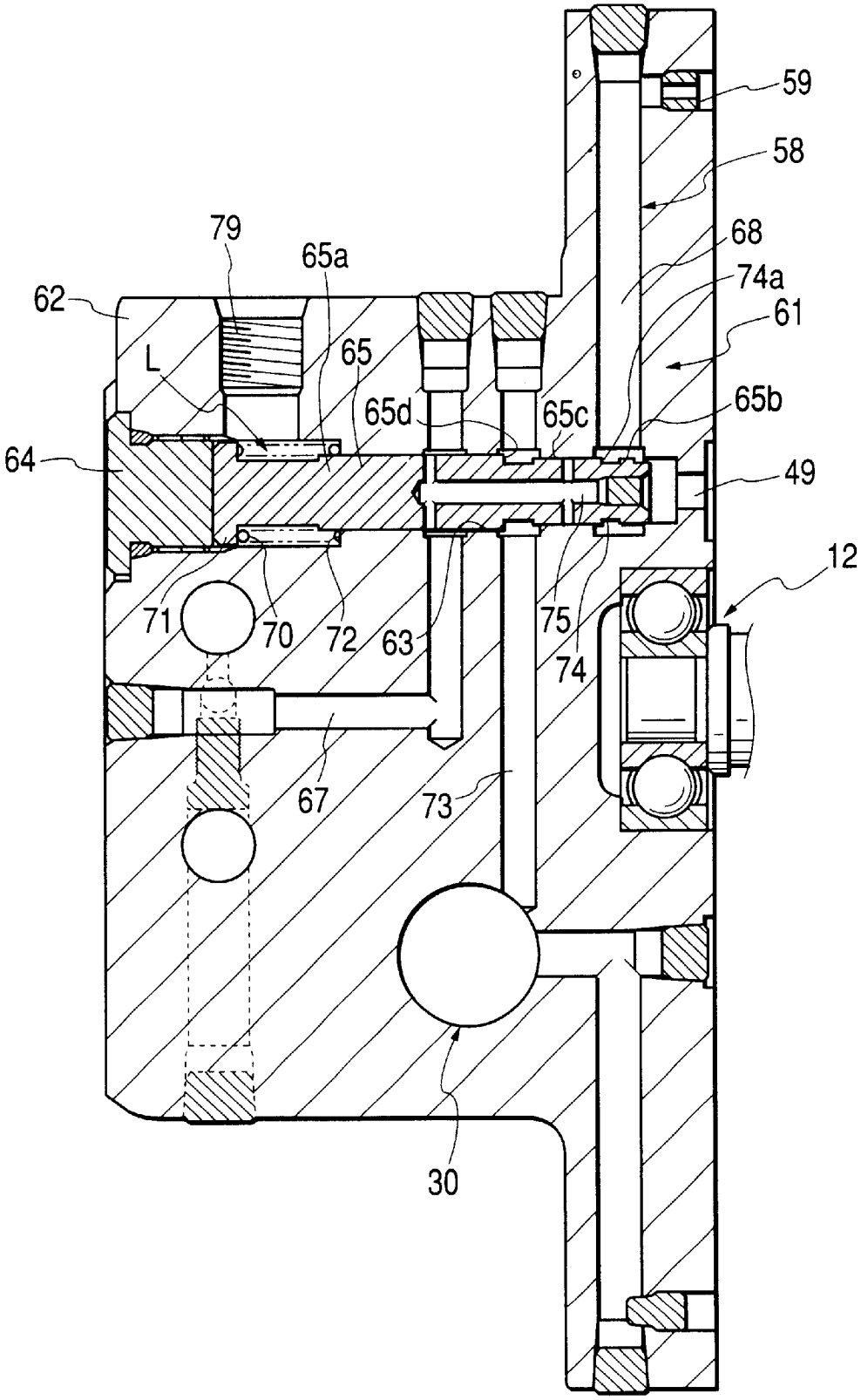
FIG. 2 is a side cross-sectional view of a changeover valve and its vicinities when the changeover valve is changed over to a low-speed position L.

Here, when the spool 65 is located in the low-speed position L as shown in FIGS. 1 and 2, one end of a passage 75 formed in the spool 65 communicates with the first passage 67, but the other end thereof is sealed by an inner periphery of the spool chamber 63 and is completely cut off from the second passage 68. The aforementioned first passage 67, second passage 68, and passage 75 as a whole make up the connecting passage 58, and this connecting passage 58 is cut off midway by the changeover valve 61 when the changeover valve 61 is changed over to the low-speed position L. In addition, when the spool is changed over to the low-speed position L as described above, the second passage 68 of the connecting passage 58 communicates with the drain passage 49 with a maximum flow passage area, and discharges the fluid acting on the tilting piston 53 as drainage.

Reference numeral 79 denotes a first pilot passage which is formed in the casing 62 and has one end connected to an unillustrated constant-pressure pilot source and the other end open in one end portion of the spool chamber 63. This first pilot passage 79 introduces a constant-pressure pilot fluid held under a constant pressure to one end face of the spool 65 of the changeover valve 61 so as to impart to the spool 65 the fluid force directed toward the other axial side, i.e., the fluid force acting in the direction for effecting a changeover to a high-speed position K.

Reference numeral 81 denotes a first notch which is formed in an outer periphery of the small-diameter portion 65*b* of the spool 65 and serves as a first narrow passage extending in the axial direction. This first notch 81 allows the drain passage 49 and the connecting passage 58 (second passage 68) extending from the changeover valve 61 on the tilting piston 53 side to communicate with each other with a narrow flow passage area midway in the stroke in which the spool 65 of the changeover valve 61 is changed over (moved) from the high-speed position K (the other axial side limit) to the low-speed position L (one axial side limit). Here, the cross-sectional area of the first notch 81 is made larger toward the other axial side, with the result that the flow passage area of the first notch 81 becomes larger as the spool 65 of the changeover valve 61 approaches the low-speed position L.

Reference numeral 82 denotes a second notch which is formed in an outer periphery of the intermediate-diameter portion 65*c* of the spool 65 and serves as a second narrow passage extending in the axial direction. This second notch 82 allows the connecting passage 58 (second passage 68) extending from the changeover valve 61 on the tilting piston 53 side and the connecting passage 58 extending from the changeover valve 61 on the selector valve 56 side, i.e., the first passage 67, to communicate with each other with a narrow flow passage area midway in the stroke in which the spool 65 of the changeover valve 61 is changed over (moved) from the high-speed position K (the other axial side limit) to the low-speed position L (one axial side limit). Here, the cross-sectional area of the second notch 82 is made larger toward one axial side, with the result that the flow passage area of the second notch 82 becomes smaller as the spool 65 of the changeover valve 61 approaches the low-speed position L.

If the first and second narrow passages are formed by the axially extending first and second notches 81 and 82 which are respectively formed in the outer periphery of the changeover valve 61, these first and second narrow passages can be provided simply at low cost.

Next, a description will be given of the operation in accordance with the first embodiment of the invention.

Figure 4:
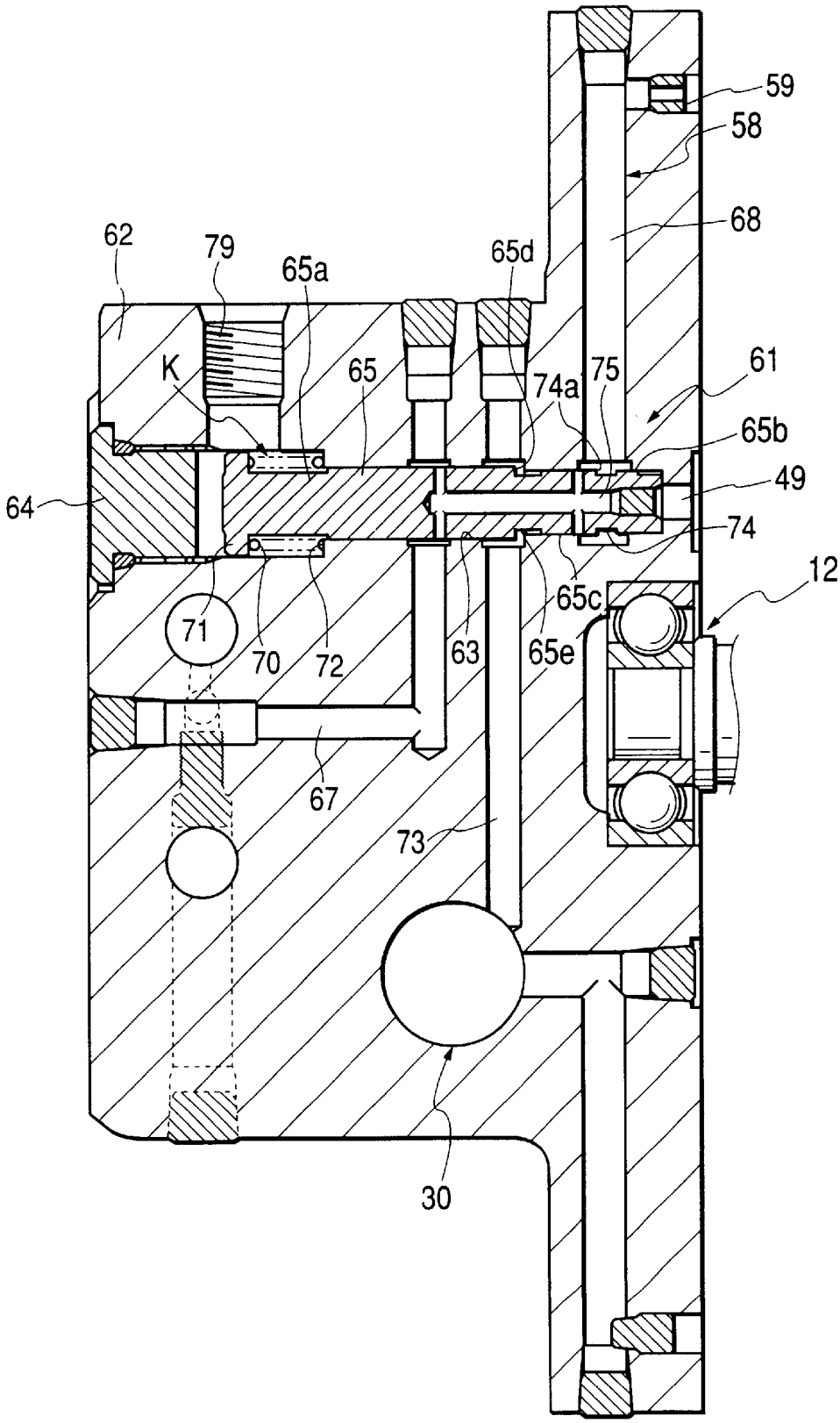
FIG. 4 is a side cross-sectional view of the changeover valve and its vicinities when the changeover valve is changed over to a high-speed position K.

It is now assumed that the manual changeover valve has been changed over to a neutral position, and that both main circuits 28 and 29 are set under the tank pressure. At this time, the rotation of the fluid motor 25 has been stopped, the counterbalance valve 30 has been returned to the neutral position, and the negative brake 45 is applying a braking force to the fluid motor 25. In addition, at this time, since the constant-pressure pilot fluid is only being introduced into the changeover valve 61 through the first pilot passage 79, the spool 65 of the changeover valve 61 has moved to the other axial side end while compressing the spring 70, and has been changed over to the high-speed position K, as shown in FIG. 4.

Next, if the manual changeover valve is changed over to supply the high-pressure fluid to either one of the main circuits, e.g., the main circuit 28, the high-pressure fluid is introduced into the valve body 33 of the counterbalance valve 30 through the pilot passage 40, so that the valve body 33 moves while compressing the spring 32, and is changed over to a first position D. At this time, the counterbalance valve 30 selectively obtains the high-pressure fluid from the high pressure-side main circuit 28, and supplies it to the negative brake 45 through the fluid path 47, so that the negative brake 45 releases the braking force with respect to the fluid motor 25, allowing the fluid motor 25 to start rotation. In addition, at this time, the counterbalance valve 30 selectively obtains the high-pressure fluid from the main circuit 28, and introduces it into the changeover valve 61 through the second pilot passage 73.

In addition, when the high-pressure fluid is supplied to the main circuit 28 as described above, after the high-pressure fluid in the main circuit 28 has been selectively obtained by the selector valve 56, the high-pressure fluid is supplied to the first passage 67. At this time, since the changeover valve 61 has been changed over to the high-speed position K as described above, the high-pressure fluid flows into the second passage 68. When the high-pressure fluid is thus introduced to the tilting piston 53 of the tilting cylinder 51 through the connecting passage 58, the tilting piston 53 and the piston rod 54 project to press the swash plate 26, and tilts the swash plate 26 to the position of high-speed rotation. At this time, the high-pressure fluid (additional pilot fluid) flowing through the connecting passage 58 is introduced to the pressure receiving surface 74*a* of the changeover valve 61 through the annular groove 74 (additional pilot passage), thereby imparting to the spool 65 a fluid force directed toward the low-speed position L.

Consequently, the fluid force based on the constant-pressure pilot fluid in the first pilot passage 79 is applied to the spool 65 of the changeover valve 61 as the changing-over force for directing the spool 65 toward the high-speed position K. Meanwhile, applied to the spool 65 of the changeover valve 61 as the changing-over force for directing the spool 65 toward the low-speed position L is the resultant force of the fluid force based on the high-pressure fluid introduced through the second pilot passage 73, the urging force of the spring 70 (a relatively weak force as described above), and the fluid force based on the high-pressure fluid (additional pilot fluid under the same pressure as the pressure within the second pilot passage 73) in the annular groove (additional pilot passage) 74.

Here, when a normal load is being applied to the fluid motor 25 (e.g., when the civil engineering and construction machine is traveling on level ground), the aforementioned changing-over force for directing the spool 65 toward the high-speed position K is larger than the aforementioned changing-over force for directing the spool 65 toward the low-speed position L, the changeover valve 61 is held at the high-speed position K.

Figure 5:
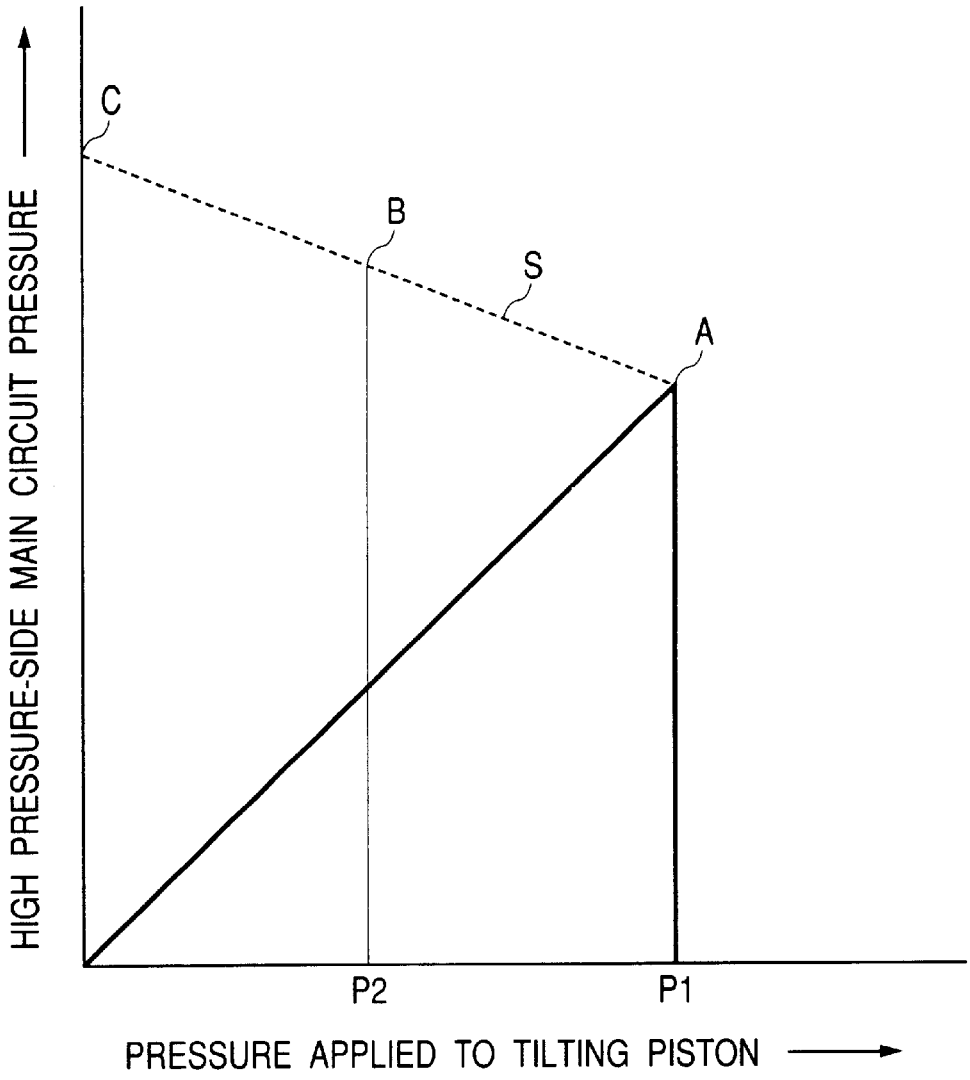
FIG. 5 is a graph illustrating the relationship between the pressure applied to a tilting piston and high pressure-side main circuit pressure.

Next, when a hill climbing operation or a steering operation is performed with respect to the above-described civil engineering and construction machine, the load acting on the fluid motor 25 increases, which in turn increases the pressure within the high pressure-side main circuit 28. However, the pressure acting on the tilting piston 53 (pressure within the connecting passage 58) also rises by following this increase, as shown by the solid line in FIG. 5. Then, when the pressure within the main circuit 28 rises to a low-speed changeover pressure P1 and reaches the point A, the resultant force of the fluid force based on the high-pressure fluid in the second pilot passage 73, the urging force of the spring 70, and the fluid force based on the additional pilot fluid in the annular groove 74 comes to exceed the fluid force based on the constant-pressure pilot fluid in the first pilot passage 79. Thus, the spool 65 starts to move toward one axial side, and the changeover valve 61 starts to be changed over from the high-speed position K to the low-speed position L.

Figure 3:
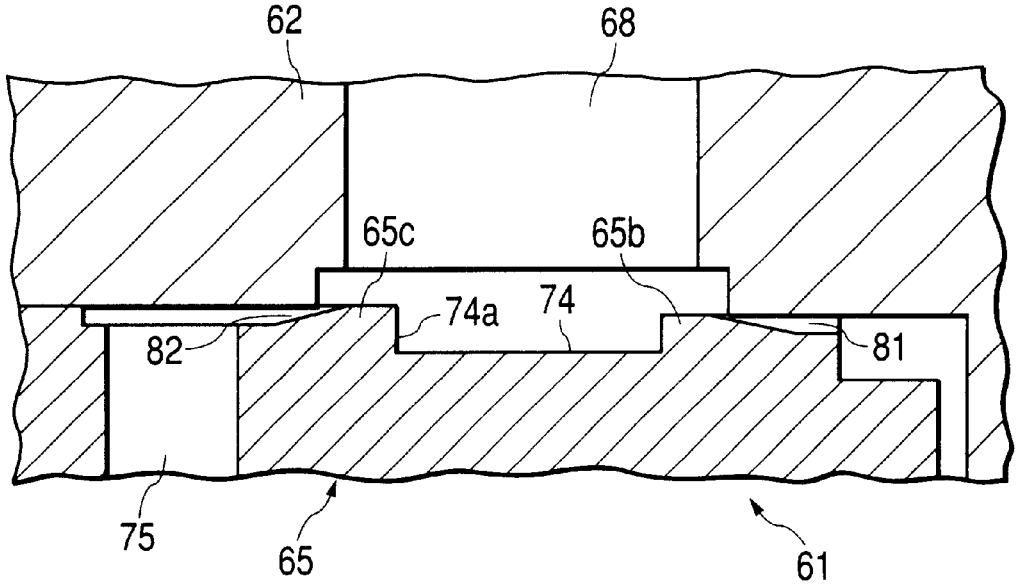
FIG. 3 is an enlarged side cross-sectional view of an additional pilot path and its vicinities.

Midway in this process of changeover to the low-speed position L (midway in the movement of the spool 65), the connecting passage 58 (second passage 68) extending from the changeover valve 61 on the tilting piston 53 side communicates with the drain passage 49 through the narrow flow passage area of the first notch (first narrow passage) 81, as shown in FIG. 3. Consequently, a small amount of the fluid in the second passage 68 is discharged to the drain passage 49, and the pressure within the second passage 68 drops. At this time, the pressure within the high pressure-side main circuit 28 gradually rises along the low-speed/high-speed changeover balance formula S of the changeover valve 61 in conjunction with the increase in the load acting on the fluid motor 25.

Then, when the pressure in the second passage 68 acting on the tilting piston 53 drops to the tilting start pressure P2 and reaches the point B, the pressing force being applied to the swash plate 26 by the tilting piston 53 becomes smaller than the tilting force being applied to the swash plate 26 by the high-pressure fluid in the fluid motor 25, so that the swash plate 26 starts to tilt from the position of high-speed rotation toward the position of low-speed rotation.

Here, when the pressure within the second passage 68 (the pressure of the additional pilot fluid) drops as described above, the fluid force being applied to the spool 65 by the additional pilot fluid also becomes small, so that the changing-over force (resultant force) for directing the changeover valve 61 toward the low-speed position L becomes small. Further, when this resultant force becomes lower than the fluid force based on the constant-pressure pilot fluid, the changeover valve 61 is pushed back toward the high-speed position K, whereas when the resultant force becomes higher than the fluid force based on the constant-pressure pilot fluid, the changeover valve 61 is pushed back toward the low-speed position L.

The spool 65 of the changeover valve 61 thus moves to the position where a balance is established between the resultant force for directing the spool 65 toward the low-speed position L and the fluid force based on the constant-pressure pilot fluid for directing the spool 65 toward the high-speed position K. Of this resultant force, the fluid force based on the additional pilot fluid in the annular groove 74 is determined by the amount of fluid flowing out from the second passage 68 into the drain passage 49 through the first notch 81 and the amount of fluid flowing from the first passage 67 into the second passage 68 through the second notch 82, i.e., by the position of the spool 65. The fluid force which is thus imparted to the spool 65 by the additional pilot fluid functions as a pressure regulator for the changeover valve 61. At this time, the swash plate 26 also tilts to an intermediate position between the position of high-speed rotation and the position of low-speed rotation in correspondence with the pressure within the annular groove 74 (second passage 68).

Then, when the pressure within the high pressure-side main circuit 28 gradually increases in correspondence with the increase in the load acting on the fluid motor 25, of the resultant force which is balanced with the fluid force of a fixed value based on the constant-pressure pilot fluid, the fluid force based on the high-pressure fluid in the second pilot passage 73 becomes gradually large. Hence, the remaining fluid force, i.e., the fluid force imparted to the changeover valve 61 by the additional pilot fluid, becomes gradually small; namely, the pressure within the second passage 68 gradually drops along the balance formula from the point B toward the point C in FIG. 5, thereby causing the swash plate 26 to tilt gradually toward the position of low-speed rotation. When the pressure within the connecting passage 58 extending from the changeover valve 61 on the tilting piston 53 side is thus caused to drop to the level of the pressure within the drain passage 49 (tank pressure), the changeover valve 61 is changed over to the low-speed position L, and the swash plate 26 tilts to the position of low-speed rotation.

While the swash plate 26 tilts from the position of high-speed rotation to the position of low-speed rotation in the above-described manner, the pressure within the high pressure-side main circuit 28 of the fluid motor 25 does not undergo a sharp drop and only rises gradually in correspondence with the load under constant-pressure control. Therefore, no shock occurs in the drive circuit, the operational feeling improves, a long life is obtained, and the occurrence of hunting is prevented. At this time, the above-described operation can be controlled with high accuracy if an arrangement is provided such that the flow passage area of the first notch 81 becomes larger as the spool 65 of the changeover valve 61 approaches the low-speed position L, and such that, meanwhile, the flow passage area of the second notch 82 becomes smaller as the spool 65 of the changeover valve 61 approaches the low-speed position L.

Figure 6:
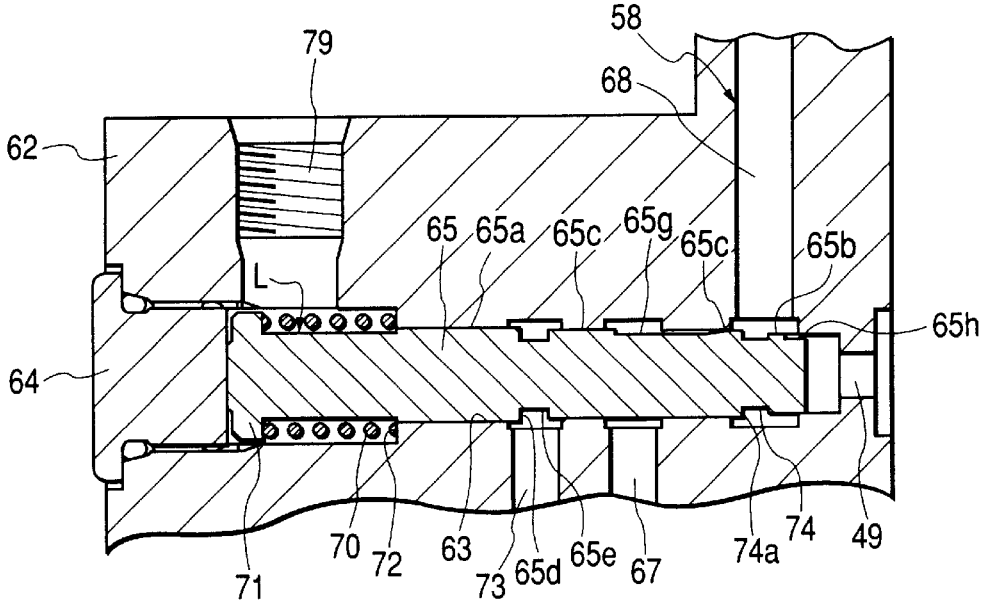
FIG. 6 is a side cross-sectional view of the changeover valve and its vicinities when the changeover valve is changed over to the low-speed position L, and illustrates a second embodiment of the invention.

FIG. 6 is a diagram illustrating a second embodiment of the invention, portions identical to those of the above-described first embodiment are denoted by the same reference numerals, and a detailed description thereof will be omitted. In this embodiment, the other end of the connecting passage be 58 (first passage 67) extending from the changeover valve 61 on the selector valve 56 side is made open in the spool chamber 63 opposing an axially central portion of the intermediate-diameter portion of the spool 65, and instead of the above-described second notch 82 only one second narrow groove 65*g* serving as the second 95 narrow passage extending in the axial direction and having a fixed width is formed in an outer periphery of an axially central portion of the intermediate-diameter portion 65*c*. Consequently, the second passage 68 and the first passage 67 are made to communicate with each other with the narrow flow passage area of the second narrow groove 65*g* midway in the stroke in which the spool 65 of the changeover valve 61 is changed over (moved) from the high-speed position K (the other axial side limit) to the low-speed position L (one axial side limit).

In addition, instead of the first notch 81 only one first narrow groove 65*h* serving as the first narrow passage extending in the axial direction and having a fixed width is formed in an outer periphery of the other axial end portion of the small-diameter portion 65*b* of the spool 65. Consequently, the second passage 68 and the drain passage 49 are made to communicate with each other with the narrow flow passage area of the first narrow groove 65*h* midway in the stroke in which the spool 65 of the changeover valve 61 is changed over (moved) from the high-speed position K (the other axial side limit) to the low-speed position L (one axial side limit). If the arrangement is provided ad in this second embodiment, the passage 75 having a complicated structure need not be formed in the spool 65, so that the fabrication cost can be lowered. It should be noted that the other arrangements and operation are similar to those of the above-described first embodiment.

Figure 7:
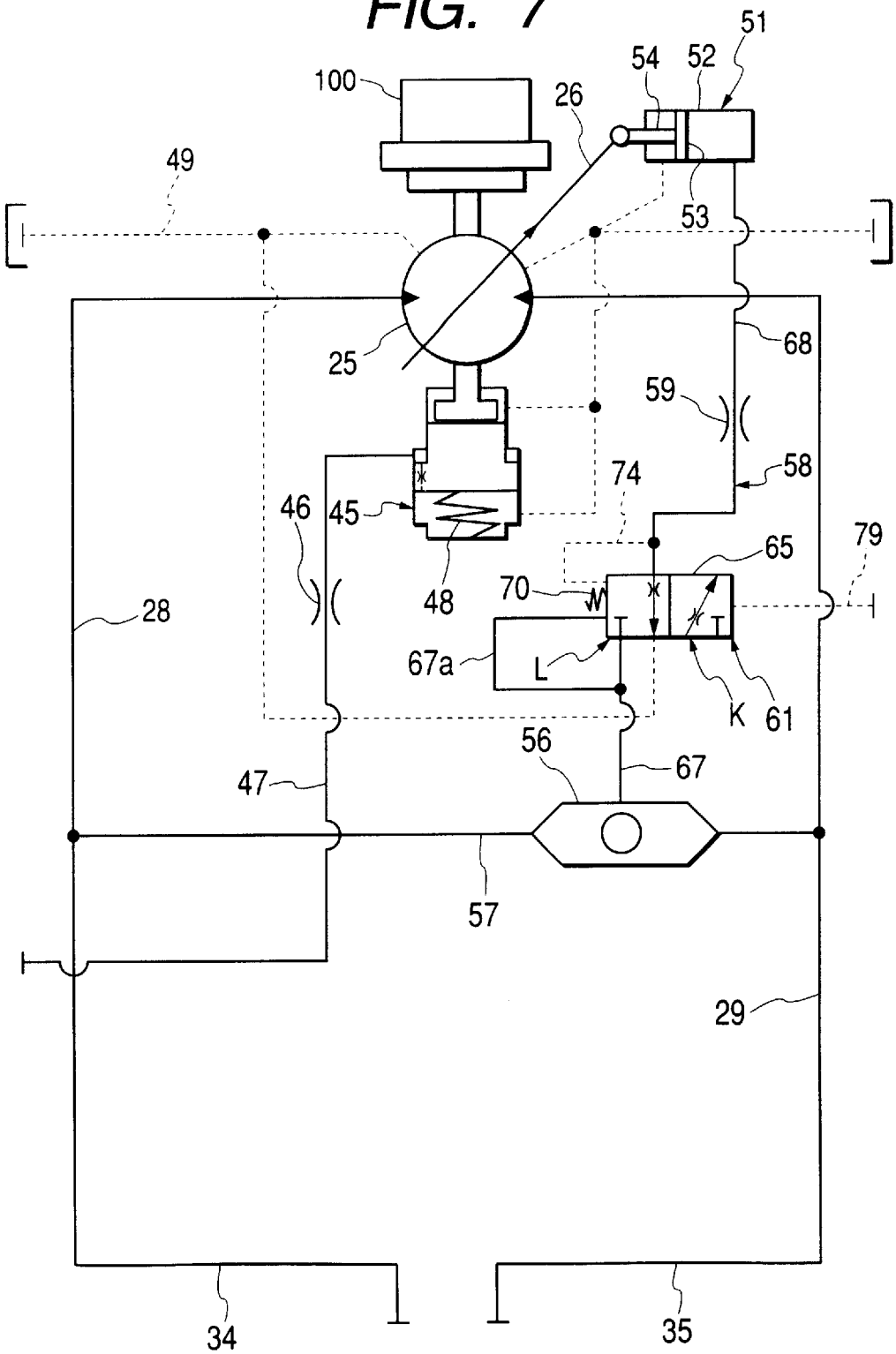
FIG. 7 is a circuit diagram illustrating a third embodiment of the invention.
Figure 8:
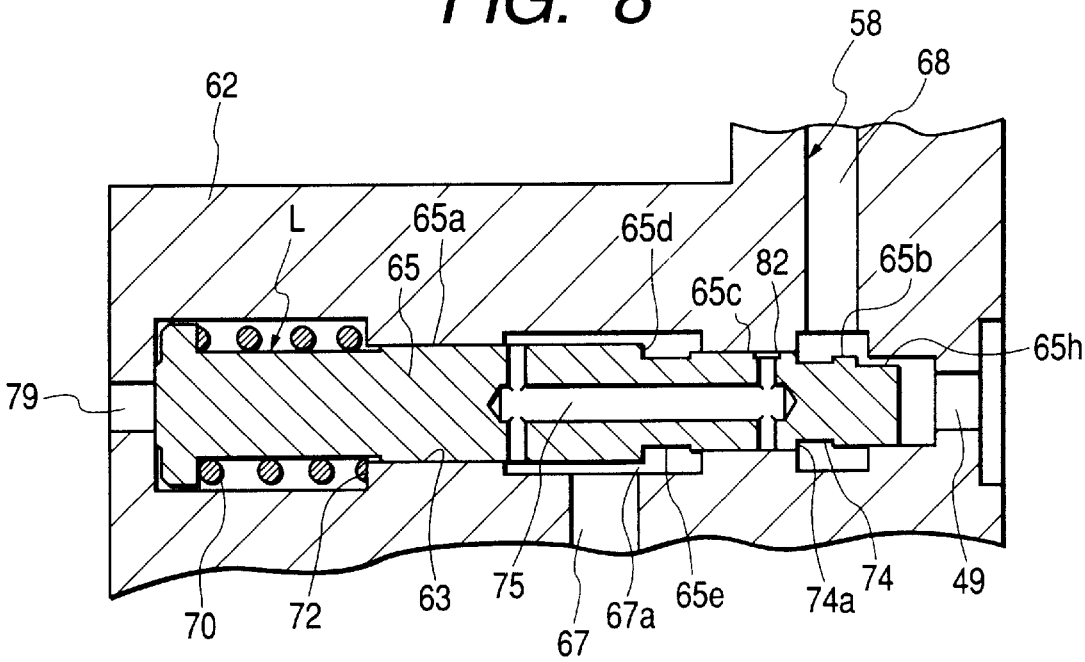
FIG. 8 is a side cross-sectional view of the changeover valve and its vicinities when the changeover valve is changed over to the low-speed position L.

FIGS. 7 and 8 are diagrams illustrating a third embodiment of the invention, portions identical to those of the above-described first embodiment are denoted by the same reference numerals, and a detailed description thereof will be omitted. In this embodiment, the counterbalance valve 30 and the second pilot passage 73 formed in the casing 62 in the first embodiment are omitted, and a second pilot passage 67*a* branching off from the first passage 67, i.e., midway from the connecting passage 58 extending from the changeover valve 61 on the selector valve 56 side, is provided, so that the high-pressure fluid selectively obtained from the main circuits 28 and 29 by the selector valve 56 is introduced to the spool 65 of the changeover valve 61 as the pilot pressure.

Specifically, the width of a circumferential groove provided at the other end of the first passage 67 which is open in the spool chamber 63 is made wide, the first passage 67 is constantly made to communicate with the annular groove 65*e* formed between the large-diameter portion 65*a* and the intermediate-diameter portion 65*c*, and a gap formed between this circumferential groove and the large-diameter portion 65*a* is formed as the aforementioned second pilot passage 67*a*. Consequently, the high-pressure fluid selectively obtained from the high-pressure side of the main circuits 28 and 29 by the selector valve 56 is introduced to pressure receiving surface 65*d* of the spool 65 through the first passage 67 and the second pilot passage 67*a*.

In addition, instead of the first notch 81 only one first narrow groove 65*h* serving as the first narrow passage extending in the axial direction is formed in the outer periphery of the other axial end portion of the small-diameter portion 65*b* of the spool 65 in the same way as the above-described second embodiment. Further, since the counterbalance valve 30 is omitted in the above-described manner, the fluid path 47 for supplying to the negative brake 45 the high-pressure fluid for releasing the braking force is connected to an external circuit outside this circuit. If the arrangement is provided as in this embodiment, the counterbalance valve 30, for example, for obtaining from the main circuits 28 and 29 the high-pressure fluid (pilot fluid) to be introduced into the changeover valve 61 becomes unnecessary, so that the structure becomes simple, and the fabrication cost can be lowered. It should be noted that the other arrangements and operation are similar to those of the above-described first embodiment. In addition, the changeover valve described in the above-described second embodiment may be used instead of the changeover valve of this third embodiment.

Figure 9:
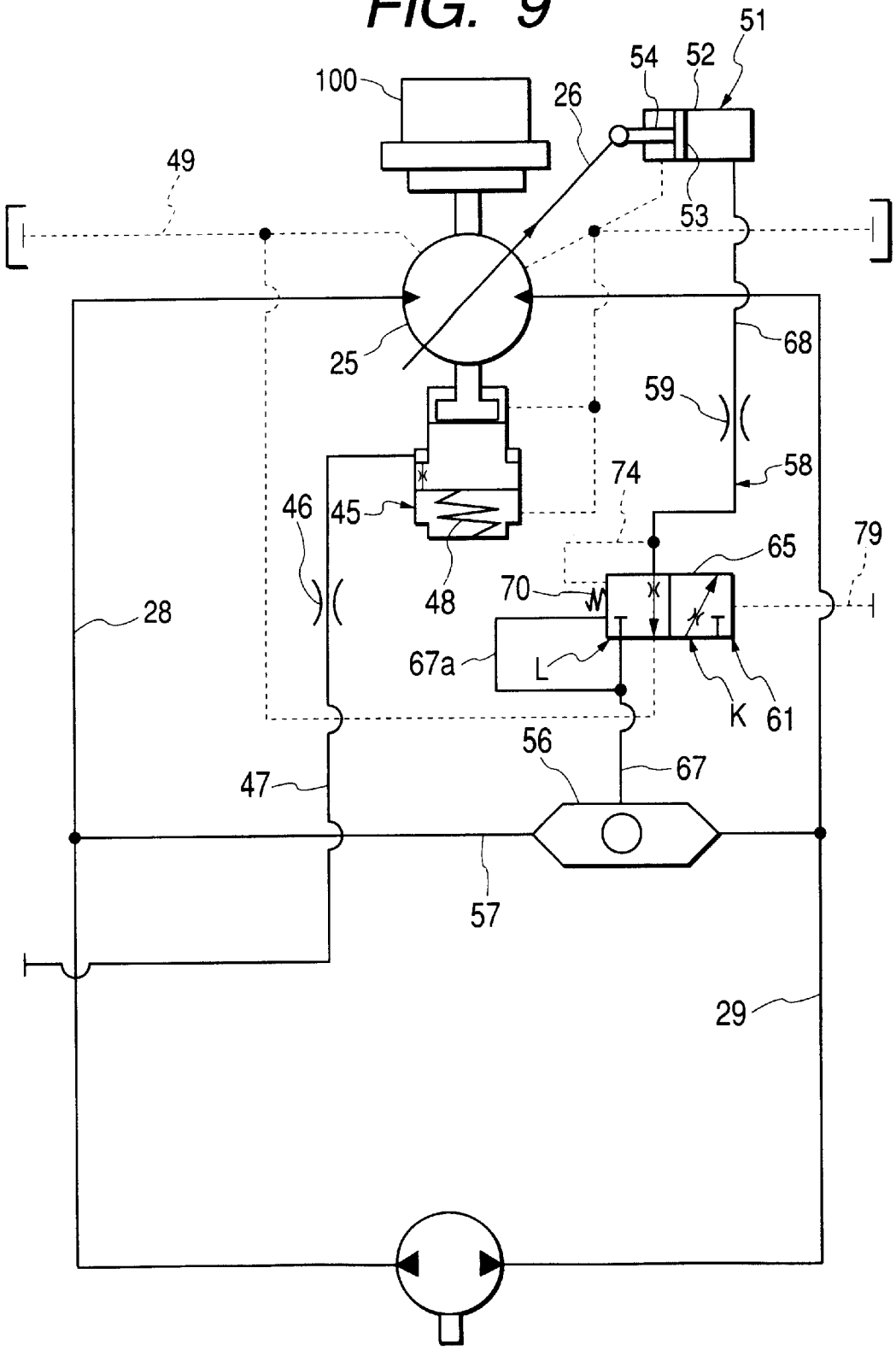
FIG. 9 is a circuit diagram illustrating a fourth embodiment of the invention
Figure 10:
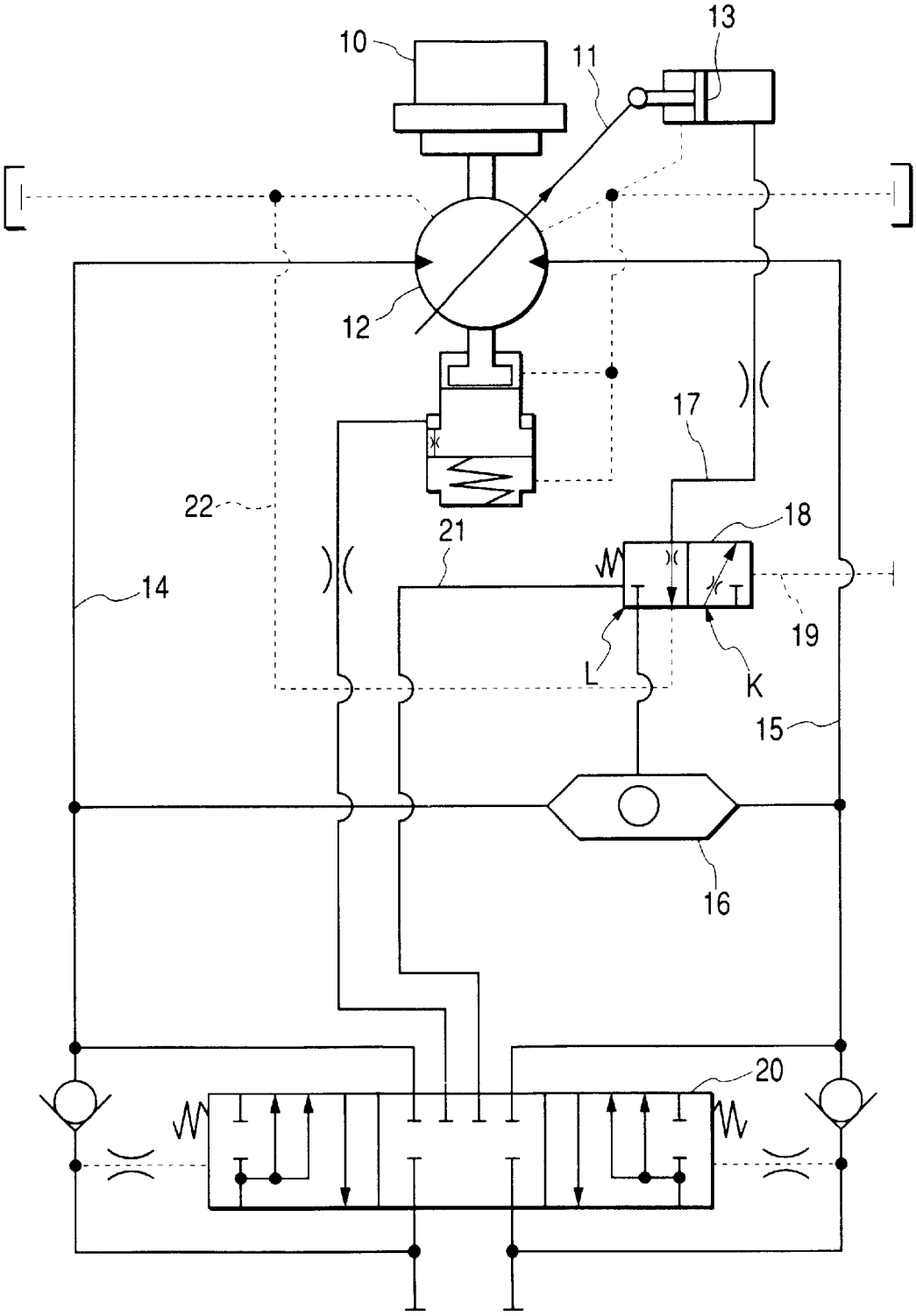
FIG. 10 is a circuit diagram illustrating an example of a related drive circuit for a fluid motor.

FIG. 9 is a diagram illustrating a fourth embodiment of the invention, portions identical to those of the above-described first embodiment are denoted by the same reference numerals, and a detailed description thereof will be omitted. In this embodiment, the manual changeover valve and the tank are not connected to the main circuits 28 and 29, and a fluid pump is directly connected to these main circuits 28 and 29 so as to form the fluid circuit as a closed circuit. It should be noted that the other arrangements and operation are similar to those of the above-described third embodiment.

It should be noted that although, in the foregoing embodiments, the selector valve 56 is used as the selector valve for obtaining the high-pressure fluid from the main circuits 28 and 29 into the connecting passage 58, in the invention, the counterbalance valve 30 may be used as the selector valve. In addition, although, in the foregoing embodiments, a description has been given of the case where the high-pressure fluid is supplied to the main circuit 28, also in the case where the high-pressure fluid is supplied to the main circuit 29 the drive circuit operates in the same way as described above. Further, the first and second narrow grooves 65*h* and 65*g* serving as the first and second narrow passages described in the above-described second embodiment may be formed not in the outer periphery of the spool 65 but in the inner periphery of the spool chamber 63.

As described above, in accordance with the invention, it is possible to improve the operational feeling and prolong the life of the drive circuit while preventing hunting at the time of changeover of the changeover valve to the low-speed position.

What is claimed is:

1. A drive circuit for a fluid motor comprising: a fluid motor having a swash plate which is tiltable between positions of high-speed and low-speed rotation; a tilting piston which, when a high-pressure fluid is introduced thereto, pushes and tilts said swash plate and tilts it to the position of high-speed rotation, and which, when set under a tank pressure, allows said swash plate to tilt to the position of low-speed rotation; a changeover valve which is interposed midway in a connecting passage for connecting said tilting piston and a selector valve for selectively obtaining the high-pressure fluid from two main circuits of said fluid motor, and which is changed over between a high-speed position for introducing to said tilting piston the high-pressure fluid obtained by said selector valve and a low-speed position for discharging the fluid acting on said tilting piston to a drain passage; a first pilot passage for introducing into said changeover valve a constant-pressure pilot fluid of a direction in which said changeover valve is changed over to the high-speed position; and a second pilot passage for introducing into said changeover valve the high-pressure fluid, selectively obtained from said main circuits, of a direction in which the changeover valve is changed over to the low-speed position, said drive circuit for a fluid motor further comprising:

an additional pilot passage (74) for introducing, from a portion of said connecting passage between said changeover valve and said tilting piston into said changeover valve, an additional pilot fluid of the direction in which said changeover valve is changed over to the low-speed position, and that a first narrow passage (81, 65*h*) for allowing said drain passage and a portion of said connecting passage extending from said changeover valve on a tilting piston side to communicate with each other midway in a stroke in which said changeover valve is changed over from the high-speed position to the low-speed position; and a second narrow passage (82, 65*g*, 82) for allowing the portion of said connecting passage extending from said changeover valve on the tilting piston side and a portion of said communicating passage extending from said changeover valve on said selector valve side to communicate with each other midway in a stroke in which said changeover valve is changed over from the high-speed position to the low-speed position.

2. The drive circuit for a fluid motor according to claim 1, wherein said first narrow passage is formed such that a flow passage area thereof becomes larger as said changeover valve approaches the low-speed position, while said second narrow passage is formed such that a flow passage area thereof becomes smaller as said changeover valve approaches the low-speed position.

3. The drive circuit for a fluid motor according to claim 1, wherein said first and said second narrow passages are notches formed in an outer periphery of a spool of said changeover valve in such a manner as to extend in an axial direction.

4. The drive circuit for a fluid motor according to claim 1, wherein said first and said second narrow passages are narrow grooves formed in an outer periphery of a spool of said changeover valve or in an inner periphery of a spool chamber for accommodating said changeover valve in such a manner as to extend in an axial direction.

5. The drive circuit for a fluid motor according to claim 1, wherein said second pilot passage is branched off from said connecting passage extending from said changeover valve on the selector valve side so as to introduce into said changeover valve the high-pressure fluid obtained by said selector valve.

* * * * *